US008776954B2

(12) United States Patent
Wu et al.

(10) Patent No.: US 8,776,954 B2
(45) Date of Patent: Jul. 15, 2014

(54) CAR DESTINATION FLOOR INDICATION DEVICE

(75) Inventors: Wei Wu, Tokyo (JP); Masayuki Inata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 520 days.

(21) Appl. No.: 13/201,711

(22) PCT Filed: Mar. 10, 2009

(86) PCT No.: PCT/JP2009/054520

§ 371 (c)(1),
(2), (4) Date: Aug. 16, 2011

(87) PCT Pub. No.: WO2010/103616

PCT Pub. Date: Sep. 16, 2010

(65) Prior Publication Data

US 2011/0297487 A1 Dec. 8, 2011

(51) Int. Cl.
*B66B 1/34* (2006.01)

(52) U.S. Cl.
USPC ..... 187/391; 187/396

(58) Field of Classification Search
CPC ..... B66B 3/0002; B66B 3/0006
USPC ..... 187/247, 391–393, 395, 396, 398, 399
See application file for complete search history.

(56) References Cited

U.S. PATENT DOCUMENTS

| | | | | |
|---|---|---|---|---|
| 6,550,587 | B1 * | 4/2003 | Yuasa et al. | 187/394 |
| 6,997,288 | B2 * | 2/2006 | Kakko et al. | 187/391 |
| 7,036,635 | B2 * | 5/2006 | Rintala et al. | 187/396 |

(Continued)

FOREIGN PATENT DOCUMENTS

| | | |
|---|---|---|
| JP | 08 175770 | 7/1996 |
| JP | 2001 310882 | 11/2001 |
| WO | 2005 105643 | 11/2005 |
| WO | 2008 105050 | 9/2008 |

OTHER PUBLICATIONS

Office Action issued on Apr. 23, 2013 in the corresponding Japanese Patent Application No. 2011-503590 (with Partial English translation).
Korean Office Action issued Oct. 11, 2012, in Korea Patent Application No. 10-2011-7021090 (with Partial English translation).
Office Action issued Jul. 2, 2013 in Japanese Patent Application No. 2011/503590 (with partial English language translation).

(Continued)

*Primary Examiner* — Anthony Salata
(74) *Attorney, Agent, or Firm* — Oblon, Spivak, McClelland, Maier & Neustadt, L.L.P.

(57) ABSTRACT

There is provided a car destination floor indication device which can indicate all registered destination floors even when a large number of destination floors have been registered, and enables a user to easily grasp how the registration condition of destination floors has changed. For this purpose, a car destination floor indication device which is provided in a hall or car of an elevator and indicates destination floors of the elevator to users includes an indication section which indicates registered destination floors, and an indication control section which controls indication contents of the indication section and controls switching of a plurality of indication layouts for indicating the indication contents. The configuration is such that the indication control section performs switching of the indication layout presently being indicated to another indication layout belonging to the indication layouts when the number of registered destination floors has exceeded a first reference value and when the number of registered destination floors has become not more than a second reference value.

5 Claims, 7 Drawing Sheets

(56) References Cited

U.S. PATENT DOCUMENTS

| | | | | |
|---|---|---|---|---|
| 7,040,459 | B2 * | 5/2006 | Matsuda et al. | 187/399 |
| 7,445,090 | B2 * | 11/2008 | Bodmer et al. | 187/391 |
| 7,469,772 | B2 * | 12/2008 | Takeuchi | 187/396 |
| 7,591,348 | B2 * | 9/2009 | Takeuchi | 187/391 |
| 7,793,761 | B2 * | 9/2010 | Oberer | 187/391 |
| 8,157,059 | B2 * | 4/2012 | Takeuchi et al. | 187/396 |
| 8,403,113 | B2 * | 3/2013 | Takeuchi | 187/396 |
| 2010/0044162 | A1 | 2/2010 | Takeuchi et al. | |

OTHER PUBLICATIONS

Office Action issued Sep. 11, 2013 in Chinese Patent Application No. 200980157952.1 with English language translation.

International Search Report issued May 12, 2009 in PCT/JP09/054520 filed Mar. 10, 2009.

International Preliminary Report on Patentability and Written Opinion issued Oct. 27, 2011 in Application No. PCT/JP2009/054520.

Chinese Office Action issued Jan. 30, 2013, in China Patent Application No. 200980157952.1 (with partial English translation).

* cited by examiner

CAR DESTINATION FLOOR INDICATION DEVICE

TECHNICAL FIELD

The present invention relates to a car destination floor indication device.

BACKGROUND ART

Destination floor indication means indicating a floor at which an elevator is scheduled to stop as a destination of the elevator, and the function of this destination floor indication has hitherto been borne by a destination floor registration button of a car operating panel which serves to work also as the function of destination floor registration. That is, in a conventional car operating panel, the configuration is such that one destination floor registration button is provided for one destination floor, that a label showing the name of a destination floor is indicated in the center of this destination floor registration button, and that upon pressing this destination floor registration button, the surrounding area of the label of the button in question lights up to indicate the completion of the registration of the destination floor. The destination floor indication of the elevator in question has been carried out by the lighting up of such a button.

Examples of such a conventional destination floor registration device include the one shown in FIG. 7. In FIG. 7, a car destination floor registration device 3 is provided with one destination floor registration button 11 for one destination floor, and a label showing the name of a destination floor is indicated in the center of this destination floor registration button 11. Upon pressing one of these destination floor registration buttons 11, the surrounding area of the label of the button in question lights up. Also, the car destination floor registration device 3 is provided with a door open button 12 to indicate door opening and a door close button 13 to indicate door closing.

However, if a destination floor registration button is provided for each destination floor, in the case where there are a large number of destination floors as in a high-rise building and the like, it becomes necessary to arrange a large number of destination floor registration buttons accordingly, and a large installation space becomes necessary, posing the problem of limitation to the installation positions, the problem of high costs required by installation, and the like.

Therefore, it is known that a numerical key type destination floor registration device as shown in FIG. 8 is provided to enable a large number of destination floors to be designated in a limited installation space.

In FIG. 8, therefore, a car destination floor registration device 3 is provided with numerical key buttons 14 corresponding to digits of 0 to 9 as well as a registration operation and a cancellation operation.

However, in this numerical key type destination floor registration device, the buttons and the destination floors are not in a one-to-one relation and hence it is impossible to cause the registration buttons to serve also for destination floor indication, and it is necessary to separately provide a destination floor indication device, which was unnecessary in the above-described case where the destination floors and the registration buttons are in one-to-one relation, because the registration buttons are caused to serve also for destination floor indication.

In a conventional car destination floor indication device provided in an elevator having such a numerical key type destination floor registration device, there is known a car destination floor indication device which is provided within a car of an elevator installed in a high-rise building having a large number of floors and the like, and is equipped with a destination floor registration device (a car button panel), which has destination floor buttons including numerical keys to indicate destination floors, and a destination floor indication device (an indicator), which is provided above the car entrance of a car, has indication portions, each having an LED lamp inside, in quantities equal to the number of destination floors, and causes (the LED lamps of) the indication portions corresponding to the destination floors registered by the operation of the above-described destination floor registration device to light up (refer to Patent Document 1, for example).

Furthermore, there is known a car destination floor indication device which is such that in an indication portion having a screen which permits selective indication of destination floor indications related to all floors, only the destination floor indication of the destination floors which are being registered is indicated by being positioned in the state of a matrix of fixed size (refer to Patent Document 2, for example), and also there is known a car destination floor indication device which is such that in an indication portion which indicates registered destination floor to users, all of the registered destination floors are indicated, in the case where the number of indications of the registered destination floors exceeds a prescribed specified value, in a smaller indication size than the size adopted when the above-described specified value is not exceeded (refer to Patent Document 3, for example).

Patent Document 1: Japanese Patent Laid-Open No. 08 17577 08-175770

Patent Document 2: International Publication No. WO2005/105643

Patent Document 3: International Publication No. WO2008/105050

DISCLOSURE OF THE INVENTION

Problems to be Solved by the Invention

However, the conventional car destination floor indication device described in Patent Document 1 has problems similar to those of the conventional technique shown in FIG. 7, that is, indication portions, each having an LED lamp inside, are provided in quantities equal to the number of destination floors and hence in the case where there are a large number of destination floors as in a high-rise building and the like, it becomes necessary to arrange a large number of destination floor registration buttons accordingly and a large installation space becomes necessary, posing the problem of limitation to the installation positions, the problem of high costs required by installation, and the like.

On the other hand, in the conventional car destination floor indication device described in Patent Document 2, because of the adoption of an indication portion having a screen which permits selective indication of destination floor indications related to all floors, the area of the screen which is necessary for indicating the registered destination floors is small even in the case where there are a large number of destination floors of a building. However, because the registered destination floors are indicated by being positioned in the state of a matrix of fixed size, there is an upper limit to the number of destination floors which can be indicated, and when a large number of destination floor registrations have been carried out, there is a possibility that not all of the registered destination floors can be displayed.

Hence, in the conventional car destination floor indication device described in Patent Document 3, in the case where the number of indications of the registered destination floors exceeds a prescribed specified value, all of the registered destination floors are indicated in an indication portion in a smaller indication size than the size adopted when the above-described specified value is not exceeded. However, according to the description of paragraph 0019 and the flowchart of FIG. 3 of Patent Document 3, the indication of an initial screen is performed by deleting all destination floors in the case where there is an input of delete information to the effect that a destination floor is to be deleted, and no consideration is taken as to how destination floor indication is performed for the deletion of the destination floor in question due to the arrival of a car at a registered destination floor.

Therefore, in the case where the deletion of the destination floor in question due to the arrival of a car at a registered destination floor and a new destination floor registration by a user have been successively performed, there is a problem that it may become difficult for a user to grasp how the registration condition of destination floors has changed, and there is a problem that it is possible that a user cannot easily view an indication due to the occurrence of the flickering and the like of a screen indication.

The present invention was made to solve such problems, and provides a car destination floor indication device which can indicate all registered destination floors even when a large number of destination floors have been registered, enables a user to easily grasp how the registration condition of destination floors has changed even when the deletion of the destination floor in question due to the arrival of a car at a registered destination floor and a new destination floor registration by a user have been successively performed, and ensures that a user can easily view an indication because the flickering and the like of a screen indication little occur.

Means for Solving the Problems

A car destination floor indication device according to the present invention which is provided in a hall or car of an elevator and indicates destination floors of the elevator to users comprises an indication section which indicates registered destination floors and an indication control section which controls indication contents of the indication section and controls switching of a plurality of indication layouts for indicating the indication contents, wherein the indication control section performs switching of the indication layout presently being indicated to another indication layout belonging to the indication layouts when the number of registered destination floors has exceeded a first reference value and when the number of registered destination floors has become not more than a second reference value.

Advantages of the Invention

The car destination floor indication device of the present invention produces the effects that it is possible to indicate all registered destination floors even when a large number of destination floors have been registered and that a user can easily grasp how the registration condition of destination floors has changed.

DESCRIPTION OF SYMBOLS

Figure 1:
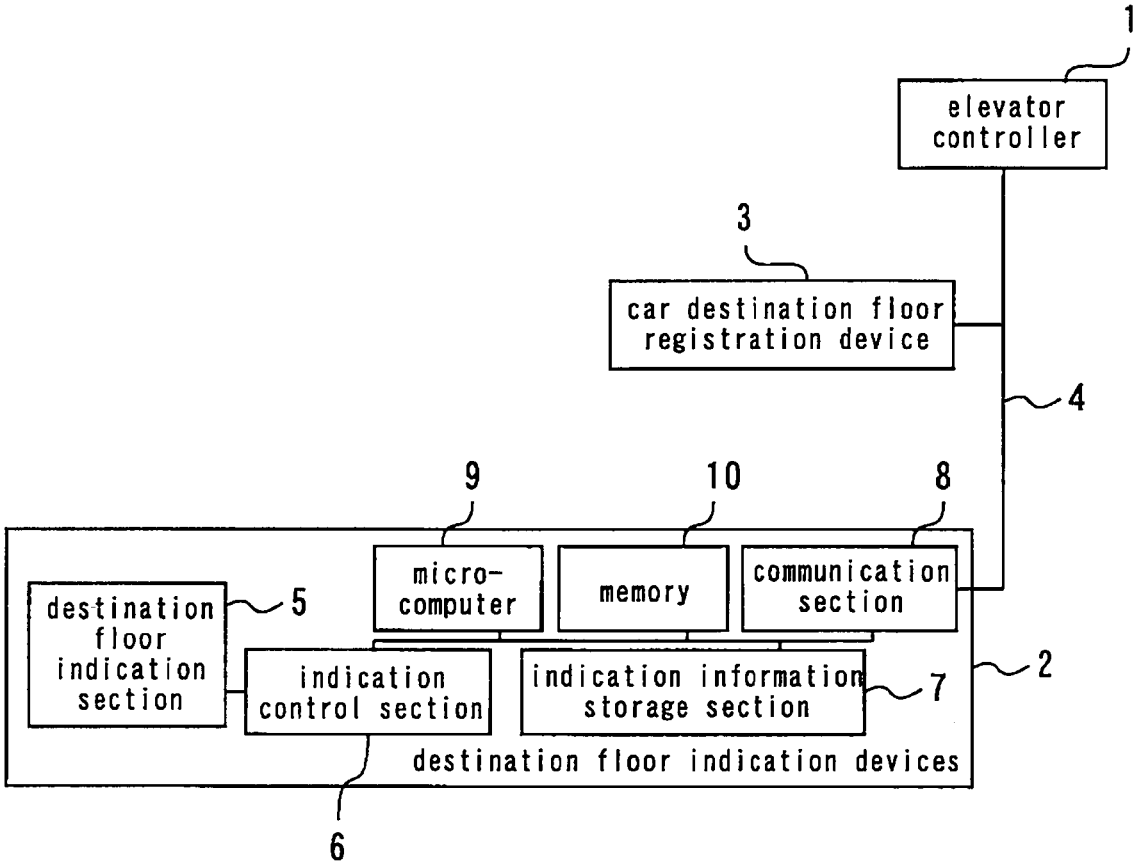
FIG. 1 is a block diagram showing the general configuration of a car destination floor indication device related to Embodiment 1 of the present invention.

1 elevator controller
2 destination floor indication devices
3 car destination floor registration device
4 communication path
5 destination floor indication section
6 indication control section
7 indication information storage section
8 communication section
9 microcomputer
10 memory
11 destination floor registration button
12 door open button
13 door close button
14 numerical key buttons

BEST MODE FOR CARRYING OUT THE INVENTION

The present invention will be described with reference to the accompanying drawings. Throughout the drawings, like reference numerals refer to like or corresponding parts and overlaps of description of these parts are appropriately simplified or omitted.

Embodiment 1

Figure 2:
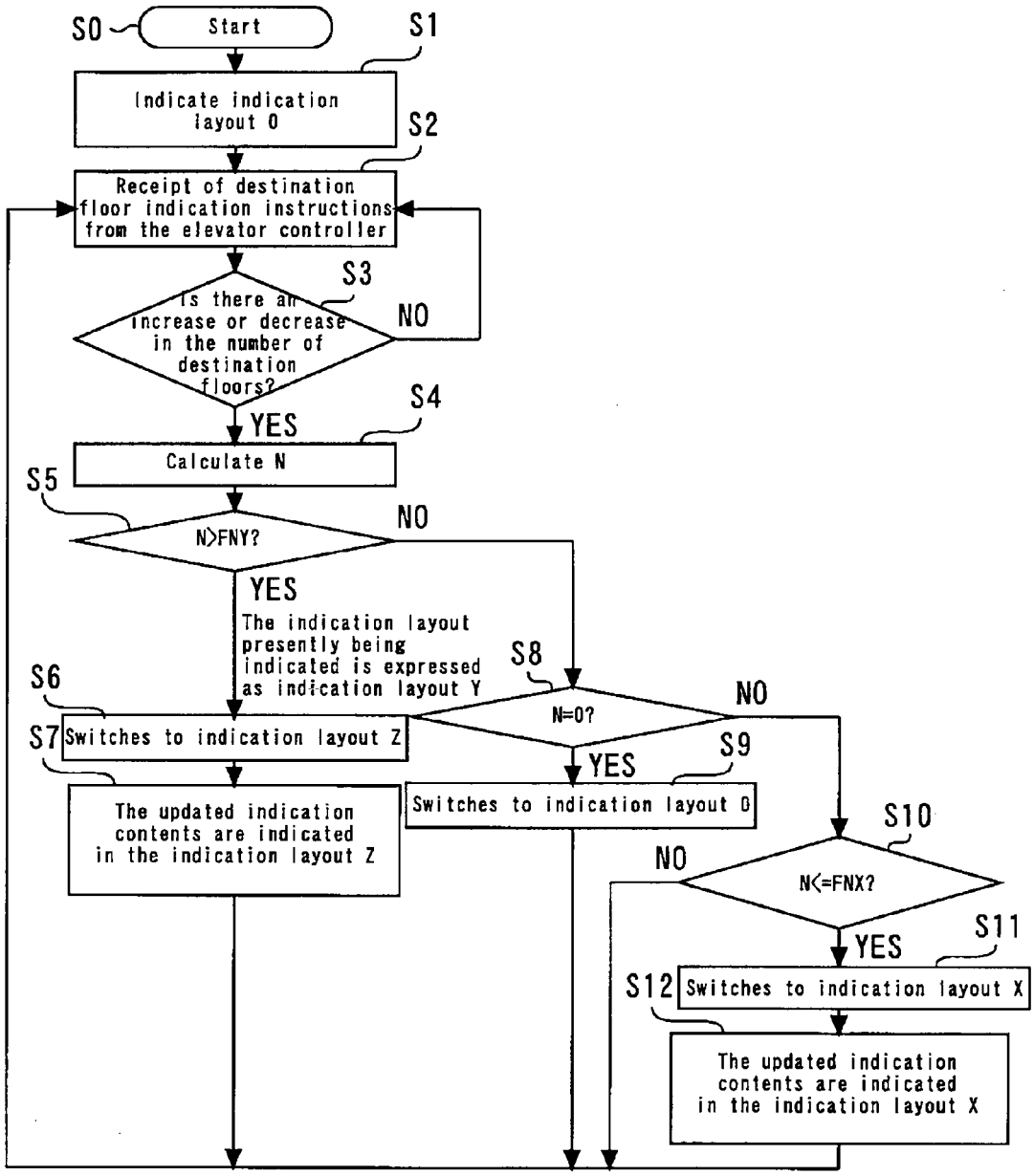
FIG. 2 is a flowchart showing the actions of the car destination floor indication device related to Embodiment 1 of the present invention.

FIGS. 1 and 2 relate to Embodiment 1 of the present invention. FIG. 1 is a block diagram showing the general configuration of a car destination floor indication device and FIG. 2 is a flowchart showing the actions of the car destination floor indication device.

In the figure, reference numeral 1 denotes an elevator controller which controls the all-embracing operation of a relevant elevator. The elevator controller causes the car of an elevator to run to a hall which has been designated by a group supervisory controller (not shown in the figure) where a user is present, allows the user to board the car there, and causes the car to run to a registered destination floor, whereby the elevator controller causes the user to be transported to the destination floor.

In the hall or car of the elevator, one or more destination floor indication devices 2 which indicate registered destination floors to users are installed. The one or more destination floor indication devices 2 are connected to the elevator controller 1 via the elevator controller 1 and a communication path 4. Between the elevator controller 1 and the destination floor indication device 2, the sending and receiving of information on registered destination floors is performed as required. In the hall or the car, there is installed a car destination floor registration device 3 which a user operates in registering his or her destination floor, and destination floor information which has been inputted by the user by operating the destination floor registration device 3 is first sent to the elevator controller 1. Upon receipt of the destination floor information, the elevator controller 1 performs necessary control, such as causing the car to run toward the registered destination floor, and sends the destination floor information to the destination floor indication device 2 connected by the communication path 4.

The destination floor indication device 2 has a destination floor indication section 5 on which a registered destination floor indication comprising digits representing the floor of the registered destination floor and graphics which qualify the digits, various kinds of character information and the like are indicted, an indication control section 6 which controls the indication processing of this destination floor indication section 5, an indication information storage section 7 which stores the correspondence relationship between instruction signals from the elevator controller 1 and indication contents (characters, graphics and the like) as instructions/indication contents correspondence tables, a communication section 8 which controls the communication with the elevator controller 1, a microcomputer 9 which performs the processing control of the whole car destination floor registration device 3, and a memory 10 comprising a program storage memory in which prescribed programs are stored and a work memory. It is necessary only that the above-described destination floor indication section 5 have the function of switching the contents to be indicated, and is formed from an indicator, such as a liquid crystal display, a plasma display, an LED and a cathode-ray tube.

The above-described communication section 8 performs the control of communication with the elevator controller 1, and through the communication with the elevator controller 1 the communication section 8 obtains the number of registered destination floors, indication instructions of destination floors, and furthermore the operation condition of the elevator (passengers are getting on and off, the car is running, and the like). For the communication path 4 used by this communication section 8, any communication method can be used so long as information communication is possible, particularly whether the cable type or the wireless type is adopted.

The above-described microcomputer 9 executes prescribed programs stored in the above-described program storage memory while using the above-described work memory. Specifically, first, from the communication section 8 the microcomputer 9 obtains destination floor information outputted from the elevator controller 1 as instructions. From the indication information storage section 7 the microcomputer 9 obtains the information on the indication contents corresponding to the destination floor information obtained from the communication section 8, and sends the information on the indication contents to the indication control section 6. And on the basis of the information on the indication contents, the indication control section 6 performs the indication of registered destination floors in the destination floor indication section 5.

Incidentally, the program storage memory and the work memory, i.e., the memory 10 and the indication information storage section 7 may comprise any storage device and storage element, such as a hard disk drive, a non-volatile memory and a dynamic random access memory, and some of these may constitute the same storage device and storage element. And the indication control section 6, the indication information storage section 7, the communication section 8 and the memory 10 may be such that part or all of these are incorporated in the microcomputer 9. Furthermore, when the communication 8 is omitted in the configuration, a detachable non-volatile storage is used as the indication information storage section 7.

In the above-described indication information storage section 7, in addition to the above-described instructions/indication contents correspondence tables, there are stored information on characters, graphics and the like of the indication contents showing destination floors and the indication places thereof, i.e., indication layouts, upper limit values of the number of destination floors which can be simultaneously indicated (hereinafter referred to as "the upper limit number of destination floors which can be simultaneously indicated") on the destination floor indication section 5 in each of the indication layouts, and the indication size of destination floor names in each indication layout.

In this embodiment, the indication layout adopted when no destination floor has been registered is expressed as indication layout 0, and according to the upper limit number of destination floors which can be simultaneously indicated, it is supposed that indication layout 1, indication layout 2, . . . , indication layout (N−1), and indication layout N, a total of N+1 indication layouts are set. And when the upper limit number of destination floors which can be simultaneously indicated in these indication layouts excluding indication layout 0 are expressed as FN1, FN2, . . . , FN(N−1), and FNN, respectively, the magnitude relation of these upper limit numbers of destination floors capable of being simultaneously indicated is given by FN1<FN1<FN2< . . . <FN(N−1)<FNN. That is, with the exception of indication layout 0, the upper limit number of destination floors which can be simultaneously indicated in indication layout 1 is the smallest and the upper limit number of destination floors which can be simultaneously indicated in indication layout N is the largest.

And when the indication size of the floor name of a destination floor in these indication layouts except indication layout 0 is expressed as S1, S2, . . . , S(N−1), and SN, respectively, the magnitude relation of these floor names of destination floor is given by S1>S1>S2> . . . >S(N−1)>SN. That is, with the exception of indication layout 0, the indication size of the destination floor name in indication layout 1 is the largest and the indication size of the destination floor name in indication layout N is the smallest.

In this embodiment, the car destination floor indication device acts in accordance with the flow of a series of actions shown in FIG. 2.

First, in Step 1, the indication control section 6 controls so as to cause the destination floor indication section 5 to indicate indication layout 0. As described above, this indication layout 0 is indicated when there is no registered destination floor, and provides a necessary initial screen such as a background screen.

And upon receipt of destination floor indication instructions from the elevator controller 1 by the car destination floor registration device 3 (Step S2), in Step S3, a judgment is made as to whether or not there is an increase or decrease in the number of destination floors to be indicated under these destination floor indication instructions. Incidentally, destination floor indication instructions refer to instructions to indicate registered destination floors and instructions to delete the indication of a relevant destination floor due to the arrival of a car at a registered destination floor.

In the case where in this ascertainment in Step S3, it has been judged that there is an increase or decrease in the number of destination floors to be indicated under the destination floor indication instructions, the flow of actions proceeds to Step S4. On the other hand, the flow of actions returns to Step S2 when in the ascertainment in Step S3 it has been judged that there is no increase or decrease in the number of destination floors to be indicated under the destination floor indication instructions.

In Step S4, the number of destination floors to be indicated from now (this number is expressed as N) is counted, and the flow of actions proceeds to Step S5. In Step S5, it is ascertained whether or not the number N of destination floors to be indicated from now is larger than the upper limit number of destination floors which can be simultaneously indicated (a first reference value) for the indication layout presently being indicated. Incidentally, here, the indication layout presently being indicated is expressed as indication layout Y, the indication layout whose upper limit number of destination floors which can be simultaneously indicated is one level smaller than this indication layout Y is expressed as indication layout X, and the indication layout whose upper limit number of destination floors which can be simultaneously indicated is one level larger than this indication layout Y is expressed as indication layout Z. That is, FNX<FNY<FNZ and SX>SY>SZ.

When in this ascertainment in Step S5 it has been ascertained that the number N of destination floors to be indicated from now is larger than the upper limit number FNY of destination floors which can be simultaneously indicated for indication layout Y presently being indicated, the flow of actions proceeds to Step S6, and the indication control section 6 switches the indication of the destination floor indication section 5 to indication layout Z whose upper limit number of destination floors which can be simultaneously indicated is one level higher than the indication layout Y. And in the succeeding Step S7, the updated indication contents of registered destination floors are indicated in this indication layout Z and thereafter the flow of actions returns to Step S2.

On the other hand, when in this ascertainment in Step S5 it has been ascertained that the number N of destination floors to be indicated from now is not more than the upper limit number FNY of destination floors which can be simultaneously indicated for indication layout Y presently being indicated, the flow of actions proceeds to Step S8, and it is ascertained whether or not the number N of destination floors to be indicated from now is 0. When in this ascertainment it has been ascertained that the number N of destination floors to be indicated from now is 0, the flow of actions proceeds to Step S9, and the indication control section 6 switches the indication of the destination floor indication section 5 to indication layout 0 and thereafter the flow of actions returns to Step S2.

On the other hand, when in the ascertainment in Step S8 it has been ascertained that the number N of destination floors to be indicated from now is not 0, the flow of actions proceeds to Step S10.

In Step S10, it is ascertained whether or not the number N of destination floors to be indicated from now is not more than the upper limit number FNX (a second reference value) of destination floors capable of being simultaneously indicated for indication layout X whose upper limit number of destination floors which can be simultaneously indicated is one level smaller than the indication layout Y presently being indicated.

When in this ascertainment in Step S10 it has been ascertained that the number N of destination floors to be indicated from now is not more than the upper limit number FNX of destination floors capable of being simultaneously indicated for indication layout X, the flow of actions proceeds to Step S11, and the indication control section 6 switches the indication of the destination floor indication section 5 to indication layout X. And in the succeeding step S12, the updated indication contents of registered destination floors are indicated in this indication layout X and thereafter the flow of actions returns to Step S2.

On the other hand, when in the ascertainment in Step S10 it has been ascertained that the number N of destination floors to be indicated from now is larger than the upper limit number FNX of destination floors capable of being simultaneously indicated for indication layout X, that is, the number N of destination floors to be indicated from now is larger than the upper limit number FNX (second reference value) of destination floors capable of being simultaneously indicated for indication layout X and is not more than the upper limit number FNY (first reference value) of indication floors capable of being simultaneously indicated for indication layout Y, the switching of the indication layout is not performed, and the flow of actions returns to Step S2.

The car destination floor indication device configured as described above comprises an indication section which indicates registered destination floors, and an indication control section which controls indication contents of the indication section and controls the switching of a plurality of indication layouts for indicating the indication contents. With the upper limit number of destination floors which can be simultaneously indicated for the indication layout presently being indicated being regarded as the first reference value, and the upper limit number of destination floors which can be simultaneously indicated for another indication layout whose upper limit number of destination floors capable of being simultaneously indicated is one level smaller than the indication layout presently being indicated being regarded as the second reference value, the indication control section performs the switching from the indication layout presently being indicated to another layout when the number of registered destination floors has exceeded the first reference value and when the number of registered destination floors has become not more than the second reference value, whereby it is possible to indicate all registered destination floors even when a large number of destination floors have been registered and a user can easily grasp how the registration condition of destination floors has changed.

More specifically, the indication control section performs switching to another indication layout whose upper limit number of destination floors which can be simultaneously indicated is one level larger than the indication layout presently being indicated when the number of registered destination floors has exceeded the first reference value, and performs switching to another indication layout whose upper limit number of destination floors which can be simultaneously indicated is the second reference value when the number of registered destination floors has become not more than the second reference value, whereby it is possible to achieve the same object as described above.

Embodiment 2

Figure 3:
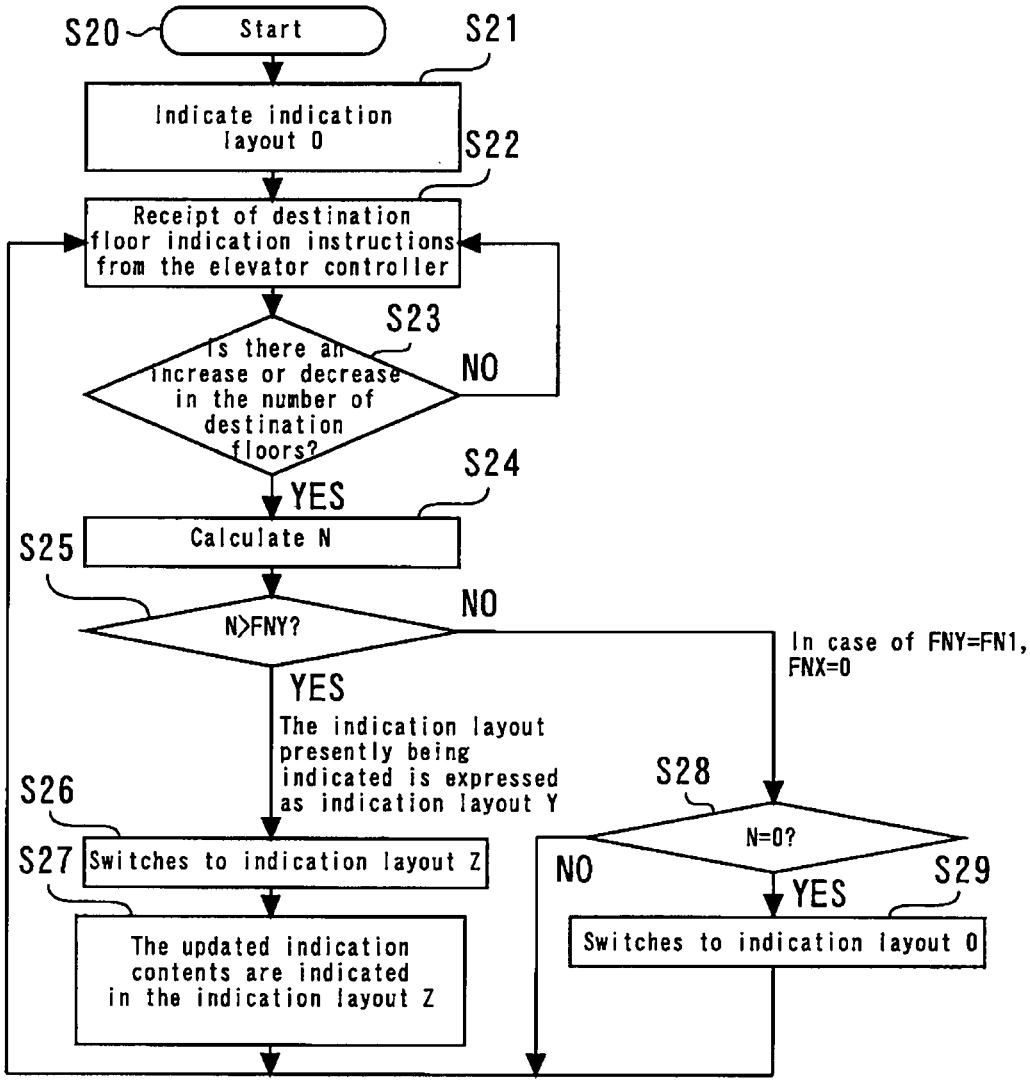
FIG. 3 is a flowchart showing the actions of the car destination floor indication device related to Embodiment 2 of the present invention.
Figure 4:
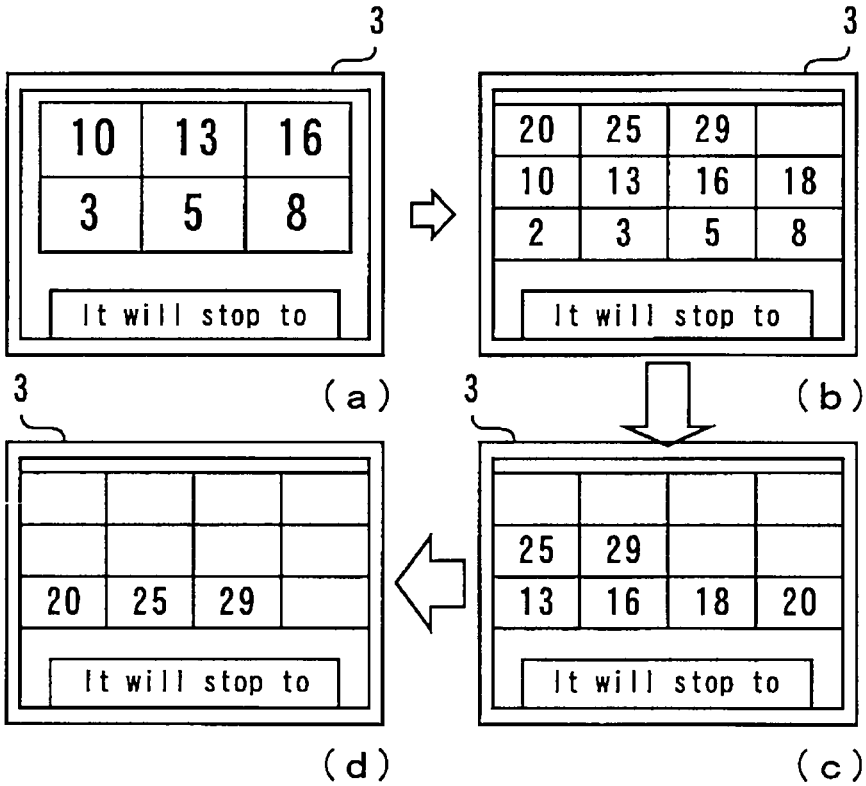
FIG. 4 is an explanatory figure showing an indication example of the car destination floor indication device related to Embodiment 2 of the present invention.

FIGS. 3 and 4 relate to Embodiment 2 of the present invention. FIG. 3 is a flowchart showing the actions of the car destination floor indication device and FIG. 4 is an explanatory figure showing an indication example of the car destination floor indication device.

In Embodiment 2 which is described here, the switching of the indication layout is performed in the same manner as in Embodiment 1 when the number of destination floors to be indicated from now has become larger than the upper limit number of destination floors capable of simultaneously indicated for the indication layout presently being indicated, whereas even when the number of registered destination floors has decreased, as a rule the switching of the indication layout is not performed when the number of destination floors to be indicated from now is not more than the upper limit number of destination floors capable of simultaneously indicated for the indication layout presently being indicated.

That is, in this embodiment, concerning the configuration, the car destination floor indication device is the same as with Embodiment 1 and concerning actions, the car destination floor indication device is in accordance with the flow of a series of actions shown in FIG. 3.

First, in Step S21, the indication control section 6 performs control so as to cause the destination floor indication section 5 to indicate indication layout 0, which provides a necessary initial screen such as a background screen.

And upon receipt of destination floor indication instructions from the elevator controller 1 by the car destination floor registration device 3 (Step S22), in Step S23, a judgment is made as to whether or not there is an increase or decrease in the number of destination floors to be indicated under these destination floor indication instructions.

In the case where in this ascertainment in Step S23, it has been judged that there is an increase or decrease in the number of destination floors to be indicated under the destination floor indication instructions, the flow of actions proceeds to Step S24. On the other hand, the flow of actions returns to Step S22 when in the ascertainment in Step S23 it has been judged that there is no increase or decrease in the number of destination floors to be indicated under the destination floor indication instructions.

In Step S24, the number N of destination floors to be indicated from now is counted and the flow of actions proceeds to Step S25. In Step S25, it is ascertained whether or not the number N of destination floors to be indicated from now is larger than the upper limit number FNY (first reference value) of destination floors capable of being simultaneously indicated for indication layout Y presently being indicated.

When in the ascertainment in Step S25 it has been ascertained that the number N of destination floors to be indicated from now is larger than the upper limit number FNY of destination floors capable of being simultaneously indicated for indication layout Y presently being indicated, the flow of actions proceeds to Step S26 and the indication control section 6 switches the indication of the destination floor indication section 5 to indication layout Z whose upper limit number of destination floors which can be simultaneously indicated is one level larger than indication layout Y. And in the succeeding step S27, the updated indication contents of registered destination floors are indicated in this indication layout Z and thereafter the flow of actions returns to Step S22 ((b) of FIG. 4).

On the other hand, when in the ascertainment of step S25 it has been ascertained that the number N of destination floors to be indicated from now is not more than the upper limit number FNY of destination floors capable of being simultaneously indicated for indication layout Y presently being indicated, the flow of actions proceeds to Step S28 and it is ascertained whether or not the number N of destination floors to be indicated from now is 0. When in this ascertainment it has been ascertained that the number N of destination floors to be indicated from now is 0, the flow of actions proceeds to Step S29 and the indication control section 6 switches the indication of the destination floor indication section 5 to indication layout 0 and thereafter the flow of actions returns to Step S22.

And when in this ascertainment in Step S28 it has been ascertained that the number N of destination floors to be indicated from now is not 0, the switching of the indication layout is not performed and the flow of actions returns to Step S22 ((c) and (d) of FIG. 4).

FIG. 4 shows indication examples of the car destination floor indication device in this embodiment. First, in condition (a), the floors of the 3rd, the 5th, the 8th, the 10th, the 13th and the 16th floor are registered as indication floors, and for the indication layout, an indication layout whose upper limit number of destination floors which can be simultaneously indicated is 6 is indicated.

When in this condition the number of registered destination floors increases due to the operation of the car destination floor indication device 3 and the like by users, the upper limit number of destination floors which can be simultaneously indicated for the present indication layout, which is 6, is exceeded and hence this indication layout switches to the indication layout whose upper limit number of destination floors which can be simultaneously indicated is 12, which is one level larger. Condition (b) shows the condition in which the destination floor registration of the 2nd, the 18th, the 20th, the 25th, and the 29th floor, a total of 5 floors, are added to condition (a).

When the car of the elevator responds to the destination floor registration from this condition and arrives at the five floors of the 2nd, the 3rd, the 5th, the 8th, and the 10th floor, the remaining registered destination floors become the six floors of the 13th, the 16th, the 18th, the 20th, the 25th, and the 29th floor. When the registered destination floors are six floors, it is possible to indicate all of the registered destination floors even by the indication layout whose upper limit number of destination floors which can be simultaneously indicated is 6. However, the indication layout remains to be the indication layout whose upper limit number of destination floors which can be simultaneously indicated is 12, and does not change. This is shown in condition (c).

Also, even when the number of registered destination floors decreases from condition (c), the indication layout does not change as shown in condition (d).

In the car destination floor indication device configured as described above, it is possible to produce the same effects as in Embodiment 1. Besides, with the upper limit number of destination floors which can be simultaneously indicated for the indication layout presently being indicated regarded as the first reference value, the indication control section switches the indication layout presently being indicated to another indication layout when the number of registered destination floors has exceeded the first reference value, and does not perform the switching of the indication layout when the number of registered destination floors decreases, whereby even when the deletion of the destination floor in question due to the arrival of a car at a registered destination floor and a new destination floor registration by a user have been successively performed, it is possible for a user to easily grasp how the registration condition of destination floors has changed and a user can easily view an indication because the flickering and the like of a screen indication little occur.

Embodiment 3

Figure 5:
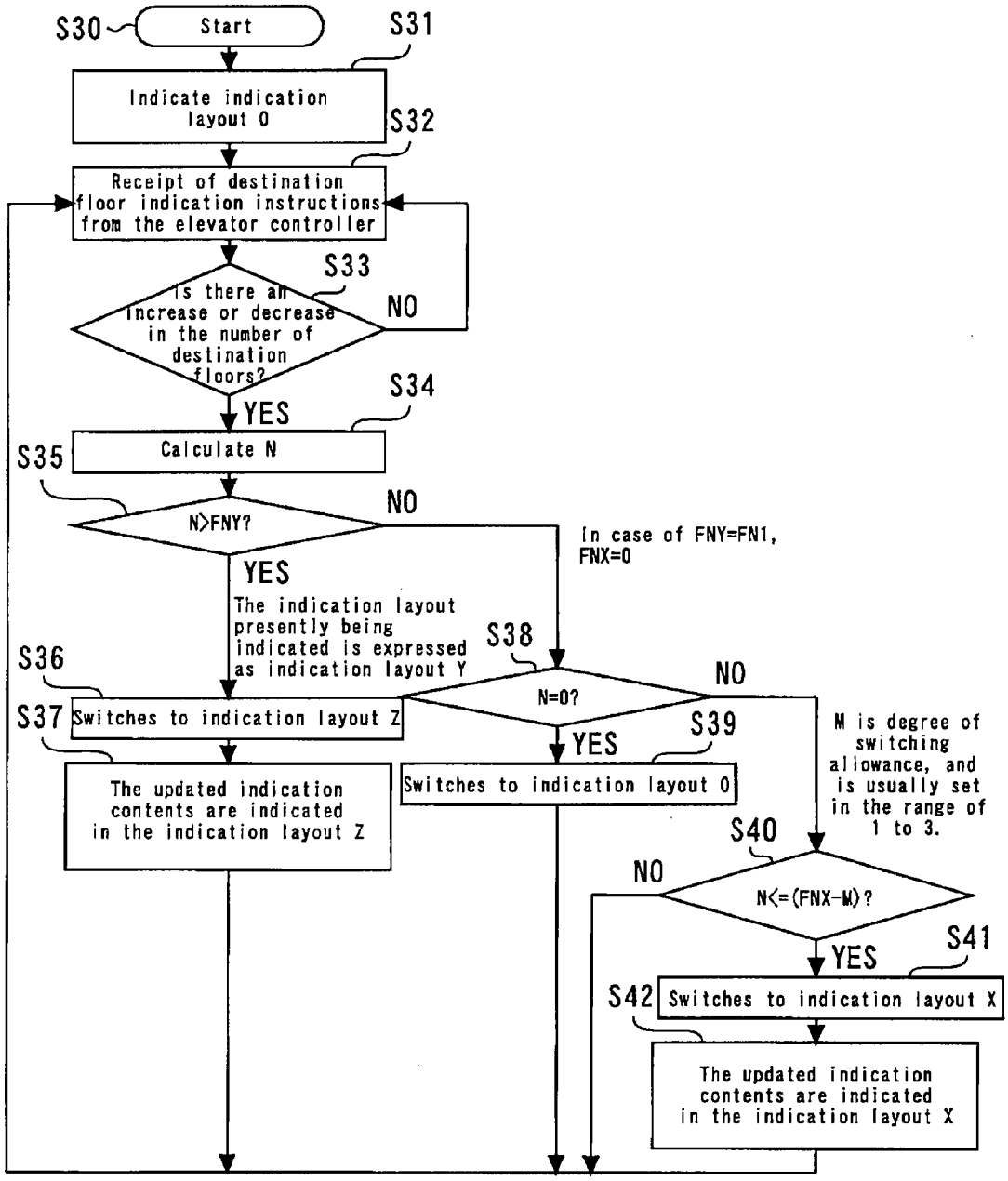
FIG. 5 is a flowchart showing the actions of the car destination floor indication device related to Embodiment 3 of the present invention.
Figure 6:
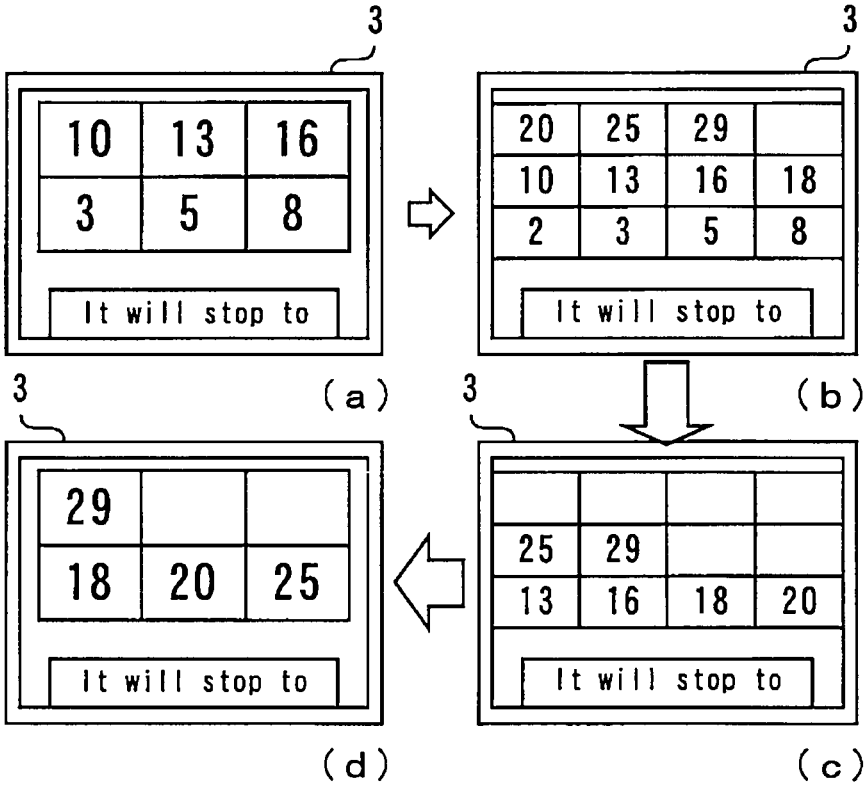
FIG. 6 is an explanatory figure showing an indication example of the car destination floor indication device related to Embodiment 3 of the present invention.
Figure 7:
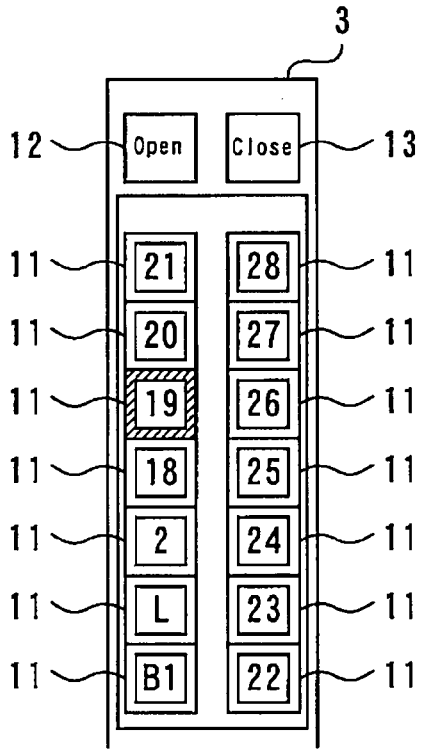
FIG. 7 is a front view showing a conventional destination floor registration device.
Figure 8:
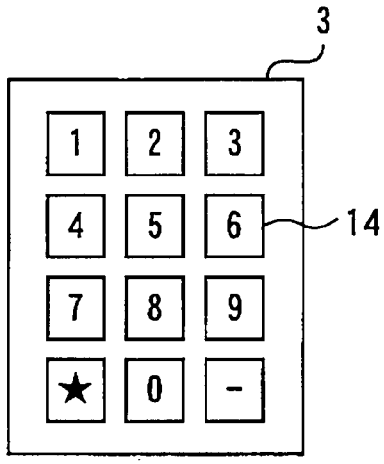
FIG. 8 is a front view showing a conventional numerical key type destination floor registration device.

FIGS. 5 and 6 relate to Embodiment 3 of the present invention. FIG. 5 is a flowchart showing the actions of the car destination floor indication device and FIG. 6 is an explanatory figure showing an indication example of the car destination floor indication device.

Embodiment 3 which is described here is the same as Embodiment 1 in that the switching of the indication layout is performed when the number of destination floors to be indicated from now has become larger than the upper limit number of destination floors which can be simultaneously indicated for the indication layout presently being indicated. And in the case where the number of destination floors to be indicated from now is not more than the upper limit number of destination floors which can be simultaneously indicated for the indication layout presently being indicated, the switching of the indication layout is not performed immediately even when the number of registered destination floors has decreased, but the switching of the indication layout is performed when the number of the floors to be indicated has decreased by the number of destination floors corresponding to a prescribed degree of switching allowance.

That is, in this embodiment, concerning the configuration, the car destination floor indication device is the same as with Embodiment 1 and concerning actions, the car destination floor indication device is in accordance with the flow of a series of actions shown in FIG. 5.

First, in Step S31, the indication control section 6 performs control so as to cause the destination floor indication section 5 to indicate indication layout 0, which provides a necessary initial screen such as a background screen.

And upon receipt of destination floor indication instructions from the elevator controller 1 by the car destination floor registration device 3 (Step S32), in Step S33, a judgment is made as to whether or not there is an increase or decrease in the number of destination floors to be indicated under these destination floor indication instructions.

In the case where in this ascertainment in Step S33, it has been judged that there is an increase or decrease in the number of destination floors to be indicated under the destination floor indication instructions, the flow of actions proceeds to Step S34. On the other hand, the flow of actions returns to Step S32 when in the ascertainment in Step S33 it has been judged that there is no increase or decrease in the number of destination floors to be indicated under the destination floor indication instructions.

In Step S34, the number N of destination floors to be indicated from now is counted and the flow of actions proceeds to Step S35. In Step S35, it is ascertained whether or not the number N of destination floors to be indicated from now is larger than the upper limit number FNY (first reference value) of destination floors capable of being simultaneously indicated for indication layout Y presently being indicated.

When in the ascertainment in Step S35 it has been ascertained that the number N of destination floors to be indicated from now is larger than the upper limit number FNY of destination floors capable of being simultaneously indicated for indication layout Y presently being indicated, the flow of actions proceeds to Step S36 and the indication control section 6 switches the indication of the destination floor indication section 5 to indication layout Z whose upper limit number of destination floors which can be simultaneously indicated is one level larger than indication layout Y. And in the succeeding step S37, the updated indication contents of registered destination floors are indicated in this indication layout Z and thereafter the flow of actions returns to Step S32 ((b) of FIG. 6).

On the other hand, when in the ascertainment of Step S35 it has been ascertained that the number N of destination floors to be indicated from now is not more than the upper limit number FNY of destination floors capable of being simultaneously indicated for indication layout Y presently being indicated, the flow of actions proceeds to Step S38 and it is ascertained whether or not the number N of destination floors to be indicated from now is 0. When in this ascertainment it has been ascertained that the number N of destination floors to be indicated from now is 0, the flow of actions proceeds to Step S39 and the indication control section 6 switches the indication of the destination floor indication section 5 to indication layout 0 and thereafter the flow of actions returns to Step S32.

And when in the ascertainment in Step S38 it has been ascertained that the number N of destination floors to be indicated from now is not 0, the flow of actions proceeds to Step S40.

In Step S40, it is ascertained whether or not the number N of destination floors to be indicated from now is small with a difference of not less than a prescribed degree of switching allowance M compared to the upper limit number FNX of destination floors capable of being simultaneously indicated for indication layout X whose upper limit number of destination floors which can be simultaneously indicated is one level smaller than the indication layout Y presently being indicated, that is, whether or not N is not more than (FNX−M) (the second reference value).

When in this ascertainment in Step S10 it has been ascertained that the number N of destination floors to be indicated from now is small with a difference of not less than a prescribed degree of switching allowance M compared to the upper limit number FNX of destination floors capable of being simultaneously indicated for indication layout X, the flow of actions proceeds to Step S41 and the indication control section 6 switches the indication of the destination floor indication section 5 to indication layout X. And in the succeeding Step S42, the updated indication contents of registered destination floors are indicated in this indication layout X and thereafter the flow of actions returns to Step S32 ((d) of FIG. 6).

On the other hand, when in the ascertainment in Step S40 it is not ascertained that the number N of destination floors to be indicated from now is small with a difference of not less than a prescribed degree of switching allowance M compared to the upper limit number FNX of destination floors capable of being simultaneously indicated for indication layout X, that is, when N is larger than (FNX−M) (the second reference value) and is not more than FNY (the first reference value), the switching of the indication layout is not performed and the flow of actions returns to Step S32 ((c) of FIG. 6).

Incidentally, a prescribed degree of switching allowance M for restraining the switching frequency of indication layouts may be a fixed value common to all indication layouts or may be values differing from one indication layout to another. And concrete values of this degree of switching allowance M is usually set in the range of 1 to 3.

FIG. 6 shows an indication example of the car destination floor indication device in this embodiment. Incidentally, the description is given in the case where the above-described degree of switching allowance M is 2, for example.

First, in condition (a), the floors of the 3 rd, the 5th, the 8th, the 10th, the 13th, and the 16th floor are registered as destination floors, and for the indication layout, an indication layout whose upper limit number of destination floors which can be simultaneously indicated is 6 is indicated.

When in this condition the number of registered destination floors increases due to the operation of the car destination floor indication device 3 and the like by users, the upper limit number of destination floors which can be simultaneously indicated for the present indication layout, which is 6, is exceeded and hence this indication layout switches to the indication layout whose upper limit number of destination floors which can be simultaneously indicated is 12, which is one level larger. Condition (b) shows the condition in which the destination floor registration of the 2nd, the 18th, the 20th, the 25th, and the 29th floor, a total of 5 floors, are added to condition (a).

When the car of the elevator responds to the destination floor registration from this condition and arrives at the five floors of the 2nd, the 3rd, the 5th, the 8th, and the 10th floor, the remaining registered destination floors become the six floors of the 13th, the 16th, the 18th, the 20th, the 25th, and the 29th floor. When the registered destination floors are six floors, it is possible to indicate all of the registered destination floors even by the indication layout whose upper limit number of destination floors which can be simultaneously indicated is 6. However, the number of registered destination floors is 6 and this is larger than the number 4, which is obtained by deducting the above-described degree of switching allowance, which is 2, from the upper limit number of destination floors which can be simultaneously indicated, which is 6, for the indication layout whose upper limit number is one level smaller than the indication layout presently being indicated. Therefore, the indication layout remains to be the indication layout whose upper limit number of destination floors which can be simultaneously indicated is 12, and does not change from this indication layout. This condition is shown in (c).

And when the number of registered destination floors decreases further from condition (c) and the number of registered destination floors becomes not more than 4, which is obtained by deducting the above-described degree of switching allowance, which is 2, from the upper limit number of destination floors which can be simultaneously indicated, which is 6, for the indication layout whose upper limit number of destination floors which can be simultaneously indicated is one level smaller than the indication layout presently being indicated, the indication layout is switched to the indication layout whose upper limit number which can be simultaneously indicated is 6 as shown in (d).

Incidentally, in this embodiment, the switching of the indication layout is not performed immediately even when the number of destination floors to be indicated from now has become not more than the upper limit number of destination floors which can be simultaneously indicated for another indication layout whose upper limit number of destination floors which can be simultaneously indicated is one level smaller than the indication layout presently being indicated, but the switching of the indication layout is performed when the number of the floors to be indicated has decreased further by the number of destination floors corresponding to a prescribed degree of switching allowance. However, the condition for performing the switching of the indication layout is not limited to this. The switching of the indication layout may be performed when a prescribed condition for switching allowance has been satisfied after the number of destination floors to be indicated from now becomes not more than the upper limit number of destination floors which can be simultaneously indicated for another indication layout whose upper limit number of destination floors which can be simultaneously indicated is one level smaller than the indication layout presently being indicated. Concrete examples of this prescribed condition for switching allowance include also the case where a prescribed time has elapsed or the like in addition to the above-described case where the number of the floors to be indicated has decreased further by the number of destination floors corresponding to a prescribed degree of switching allowance.

In the car destination floor indication device configured as describe above, it is possible to produce the same effects as in Embodiment 1. Besides, the above-described indication control section performs switching to another indication layout whose upper limit number of indication floors capable of being simultaneously indicated is the second reference value when the number of registered destination floors has become not more than the second reference value and furthermore a prescribed condition for switching allowance has been satisfied, whereby even when the deletion of the destination floor in question due to the arrival of a car at a registered destination floor and a new destination floor registration by a user have been successively performed, it is possible for a user to easily grasp how the registration condition of destination floors has changed and a user can easily view an indication because the flickering and the like of a screen indication little occur.

INDUSTRIAL APPLICABILITY

The present invention can be used in a car destination floor indication device which is installed in a hall or car of an elevator and is intended for providing information on the destination floors of the car to users.

The invention claimed is:

1. A car destination floor indication device which is provided in a hall or car of an elevator and indicates destination floors of the elevator to users, comprising:

an indication section which indicates registered destination floors; and an indication control section which controls indication contents of the indication section and controls switching of a plurality of indication layouts for indicating the indication contents, wherein the indication control section performs switching of the indication layout presently being indicated to another indication layout belonging to the indication layouts when the number of registered destination floors has exceeded a first reference value and when the number of registered destination floors has become not more than a second reference value.

2. The car destination floor indication device according to claim 1, wherein for each of the plurality of indication layouts, an upper limit number of destination floors which can be simultaneously indicated is predetermined, which is an upper limit value of the number of destination floors which can be simultaneously indicated, wherein the first reference value is the upper limit number of destination floors which can be simultaneously indicated for the indication layout presently being indicated, wherein the second reference value is the upper limit number of destination floors which can be simultaneously indicated for another indication layout belonging to the indication layouts, which has the upper limit number of destination floors which can be simultaneously indicated which is smaller than the indication layout presently being indicated and wherein the indication control section performs switching to another indication layout belonging to the indication layouts, which has the upper limit number of destination floors which can be simultaneously indicated which is larger than the indication layout presently being indicated, when the number of registered destination floors has exceeded the first reference value, and performs switching to another indication layout belonging to the indication layouts, which has the upper limit number of destination floors which can be simultaneously indicated which is the second reference value, when the number of registered destination floors has become not more than the second reference value.

3. The car destination floor indication device according to claim 2, wherein the indication control section performs switching to another indication layout belonging to the indication layouts, which has the upper limit number of destination floors which can be simultaneously indicated which is larger than the indication layout presently being indicated, when the number of registered destination floors has exceeded the first reference value, and performs switching to another indication layout belonging to the indication layouts, which has the upper limit number of destination floors which can be simultaneously indicated which is the second reference value, when the number of registered destination floors has become not more than the second reference value and furthermore a prescribed condition for switching allowance has been satisfied.

4. The car destination floor indication device according to claim 3, wherein the prescribed condition for switching allowance is that the number of registered destination floors has decreased further from the second reference value by the number of registered destination floors corresponding to a prescribed degree of switching allowance.

5. A car destination floor indication device which is provided in a hall or car of an elevator and indicates destination floors of the elevator to users, comprising:

an indication section which indicates registered destination floors; and an indication control section which controls indication contents of the indication section and controls switching of a plurality of indication layouts for indicating the indication contents, wherein the indication control section performs switching of the indication layout presently being indicated to another indication layout belonging to the indication layouts when the number of registered destination floors has exceeded a first reference value, and does not perform switching of the indication layout when the number of registered destination floors decreases.

* * * * *